United States Patent [19]

Miller

[11] 4,081,149

[45] Mar. 28, 1978

[54] MECHANISM FOR FORMING TRANSFER TAILS ON WOUND YARN PACKAGES

[75] Inventor: Harry Benjamin Miller, Charlotte, N.C.

[73] Assignee: Industrie-Werke Karlsruhe Augsburg Aktiengesellschaft, Germany

[21] Appl. No.: 690,967

[22] Filed: May 28, 1976

[51] Int. Cl.[2] ..... B65H 63/00; B65H 54/02

[52] U.S. Cl. ..... 242/18 PW; 242/125.1

[58] Field of Search ..... 242/18 PW, 18 A, 18 DD, 242/35.5 R; 57/53, 34 TT

[56] References Cited

U.S. PATENT DOCUMENTS

| | | | |
|---|---|---|---|
| 3,814,339 | 6/1974 | Hudson | 242/18 PW |
| 3,863,851 | 2/1975 | Sartori | 242/18 PW |
| 3,865,321 | 2/1975 | Miller | 242/18 A |
| 3,971,518 | 7/1976 | Newman et al. | 242/18 PW |

*Primary Examiner*—Leonard D. Christian
*Attorney, Agent, or Firm*—McGlew and Tuttle

[57] ABSTRACT

The mechanism is used with a yarn winder having a traverse guide box or housing, a traverse guide and chucks, drive rolls, and control rollers for rotating yarn package supports, such as bobbins or tubes, and provided with a yarn catching device, such as a peripheral groove or hook, adjacent one end of the package supports, with the traverse guide cross-winding yarn packages on the supports. The yarn strung up in the winder, under a tension tending to move the yarn into a traverse guide, is caught in a guide member, while restrained from entering the traverse guide, and the yarn is moved by the guide member into a position aligned with a yarn catching device for catching of the yarn which is then broken or cut. The yarn is then moved in the guide member axially of the package support to wind a few turns therealong as a transfer tail, after which the yarn is released from the guide member to enter the traverse guide for cross-winding to form the yarn package. In two embodiments of the mechanism, the yarn guide member is a metal frame formed with yarn guide slots open at one end, with the yarn movement along a slot being controlled by a control element controllably reciprocable along the slot. In a third embodiment, the yarn guide member is formed by oscillatable arms, reciprocable as a unit longitudinally of a package support, in association with a yarn deflector for restraining the yarn from entering the traverse guide.

16 Claims, 13 Drawing Figures

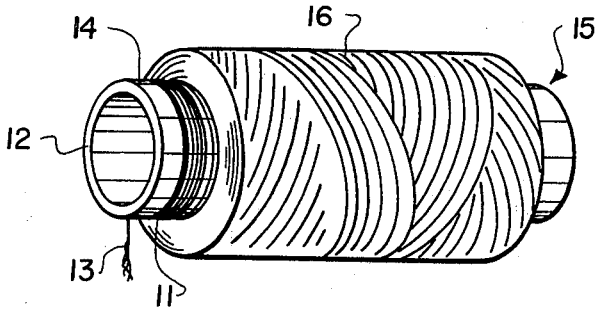
FIG. 1
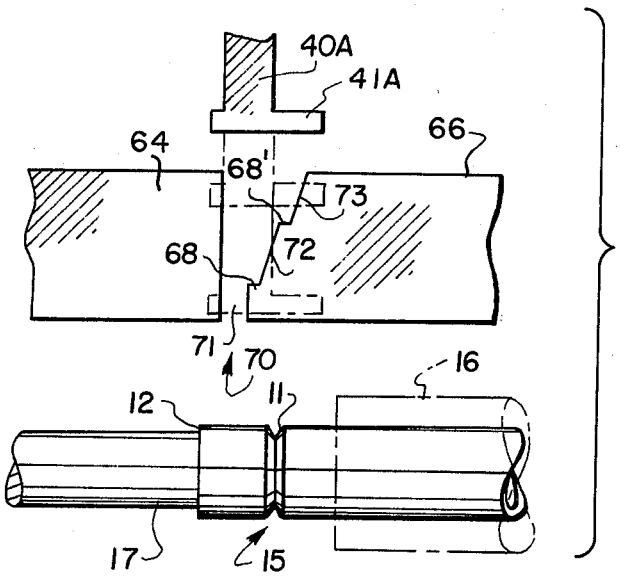
FIG. 5
FIG. 6
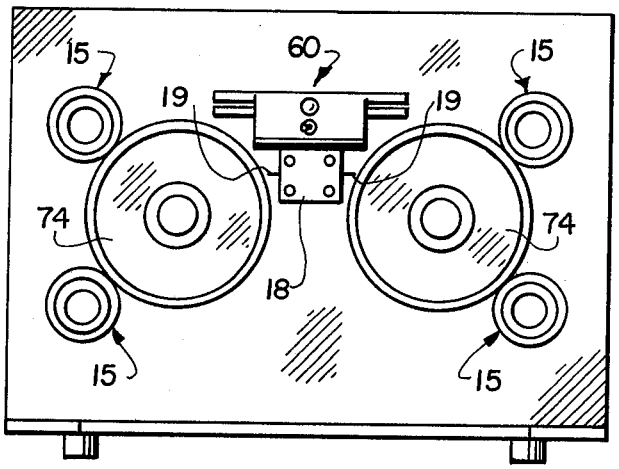

MECHANISM FOR FORMING TRANSFER TAILS ON WOUND YARN PACKAGES

FIELD AND BACKGROUND OF THE INVENTION

A "transfer tail" is well known in the textile trade as a short length of yarn at the beginning of a wound yarn package and which is used in creeling to tie the end of one package to the beginning of another package. With a transfer tail, it is possible, without stopping a machine or process, to draw yarn continuously from successive yarn packages. Thus, a creel hand or operator can remove an empty tube, replace it with a full package, and then tie the outside end of the full package to the transfer tail which is the inside end of the previous package being unwound as it supplies the process, machine, or the like. It is an undisputed fact that the use of a transfer tail makes a manufacturing process more efficient and thus more economic.

There are various known arrangements for forming transfer tails on wound yarn packages, such as yarn packages wound on bobbins or tubes. However, these known arrangements have disadvantages from the standpoints of efficient operation, economic use of available space, and ease of stringing yarn in a winder with which the known arrangements may be associated. Thus, in one known arrangement, there is a rotating or revolving mechanism mounting a pair of chucks and which is used with a so-called "single chuck" arrangement, namely, an arrangement in which there may be two chucks but with only one chuck being in engagement at a time so that only one or more bobbins are driven at a time. With this particular arrangement, two or more full bobbins are mounted on the mechanism on diametrically opposite sides thereof, and only the bobbin or bobbins on one side are driven at a time. When the first bobbins have been substantially completely unwound, the two chucks are rotated as a unit and the second bobbins are brought into driving engagement with the first bobbins being taken out of driving engagement. When used with large bobbins, such as those of the order of ten inches or larger in diameter, this known system becomes very bulky and requires a great deal of space with respect to the amount of yarn which can be wound on the bobbins as well as with respect to its operation. Consequently, it would be highly desirable to provide a transfer tail forming mechanism requiring a great deal less space and having a much simpler and more efficient construction than known mechanisms for forming transfer tails on wound yarn packages.

SUMMARY OF THE INVENTION

With the foregoing in mind, the objective of the present invention is to provide a mechanism, for forming transfer tails on wound yarn packages, which is simpler in construction, is easier to string with yarn, has a higher capacity per unit of space occupied by the mechanism, and is more efficient in operation than known mechanisms for forming transfer tails. To this end, the transfer tail forming mechanism of the invention is designed for use with a yarn winder having a traverse guide and rotating yarn package supports, particularly bobbins or tubes, provided with a yarn catching device, such as a peripheral groove on the package support, or a hook mounted on a chuck, adjacent an end of the packae support, and in which winder the traverse guide cross-winds yarn packages on the supports.

In accordance with the invention, the mechanism includes a guide member in which the yarn, strung up in the winder under a tension tending to move the yarn into the traverse guide, is caught, while the yarn is restrained from entering the traverse guide. Means are provided to control movement of the yarn in the guide member from any position along a bobbin or tube into a position in which the yarn is aligned with the yarn catching device, such as the peripheral groove, for catching of the yarn in the groove for one or two turns, with the yarn then being broken or cut. The yarn is then moved in the guide member axially of the bobbin or tube to wind a few turns therealong as a transfer tail, after which the control means are operable to release the yarn from the guide member so that the yarn will enter the traverse guide for cross-winding of the yarn packages.

When yarn is running at high speed, of the order of thousands of meters per minute, it is most efficiently handled by the use of an aspirator. Thus, when a winder is strung up with yarn to begin winding of yarn packages, the yarn is first sucked, from whatever source the yarn is coming, into an aspirator which discharges the yarn into a waste bag. Then, with the yarn running into the aspirator at high speed, the yarn is hooked into the guide member of the invention mechanism, which holds the yarn out of the traverse guide or guides until the yarn is either broken or cut and is ready to be brought into engagement with the traverse guide, for cross-winding, by a logic or control system.

An important feature of the invention is that, while a first chuck, carrying one or more bobbins, is still winding a package or packages of yarn, a second chuck, also carrying one or more bobbins, can be strung up with a transfer tail or tails while the first chuck is still winding yarn packages. The importance of this feature is that a very substantially increased throughput can be obtained. With the invention arrangement, this is made possible because the second chuck to be strung up with a transfer tail or transfer tails is displaced from the traverse guide area where winding of yarn packages is taking place on the bobbins or tubes on the first chuck. The guide member of the present invention maintains the yarn, being used to form one or more transfer tails and bobbins or tubes on the second chuck, out of engagement with the traverse guide until the transfer tails are formed. The guide member of the invention then releases the yarn or yarns to enter the traverse guide for winding of yarn packages on those bobbins or tubes on the second chuck. This is very important where it is desired to operate two chucks on the same side of the winder at the same time. Thus, a winder which normally would be switched back and forth from one chuck to another chuck to wind the four transfer tail ends, can be used, in accordance with the invention, to wind eight transfer tail ends.

In one embodiment of the invention, the guide member comprises a metal frame including a central longitudinal member mounted on a traverse guide housing or the like to extend substantially parallel to a pair of chucks each of which may have two bobbins or tubes mounted thereon in end-to-end slightly spaced relation. This central member carries or is formed with four arms including respective arms at each end of the central member projecting in respective opposite directions transversely therefrom, and two aligned central arms projecting in respective opposite directions transversely therefrom. The outer end of each transverse arm is formed with a slot into which the yarn can be engaged, and each slot has an inner end portion into which the caught yarn is biased by the tension tending to move the yarn into the traverse guide. Each slot has one or more sloping portions forming yarn guide surfaces and leading from the inner end of the associated slot to an open outer end of the slot. Respective pusher elements, constituting control elements, are associated with each arm, the two pusher elements associated with the central arms being combined to form a unit. A cam member is slidable longitudinally of the central member of the guide member and is engaged with all three pusher elements. This cam member is operable by a double acting pneumatic actuator having a cylinder mounted on the guide member and a piston connected to the cam member. The inner end of each slot is aligned with the peripheral groove adjacent the end of a respective bobbin or tube. Consequently, when the yarn is engaged in the inner end of a slot, it is restrained from entering a traverse guide and is aligned with the peripheral groove in a bobbin or tube so that the yarn can be caught in the groove, which will either grip the yarn, when it is caught in the relatively narrow groove and break it to start the transfer tail, or in the case of stronger yarn which cannot be broken, the yarn will be gripped by the groove sufficiently strongly so that, when the yarn is cut by some means, such as an aspirator or some other type of cutter, it will then start the transfer tail.

To form the transfer tail, the pneumatic actuator is operable to move the cam member in one direction to move the pushers, associated with the arms projecting from one side of the center member, outwardly to push the yarn out of the inner end of the slot, along the sloping surface or surfaces, to form the transfer tail by lateral movement of the yarn axially of the tube or bobbin, and then to release the yarn from the associated slot for engagement in the traverse guide so that the latter can cross-wind the yarn into a yarn package. Upon reverse controlled movement of the pneumatic actuator, the pushers associated with the other two outwardly projecting arms are similarly moved outwardly to push the yarn out of the inner end of the slot, along a sloping surface to form the transfer tail by the yarn moving transversely of the slot and thus axially along the bobbin or tube, and then out of the slot to release the yarn to enter the traverse guide. Preferably, the pneumatic actuator is controllably operated by applying a constant pressure to one side of the piston thereof while controlling release of air from the opposite side of the piston.

Means other than a groove in a bobbin or tube may be used for catching the yarn to start the transfer tail. Thus, a hook can be submerged in the bobbin or tube in the groove, or be provided on the chuck between bobbins, and be so designed and shaped that the yarn will easily and very rapidly slip under the hook to begin the winding of the transfer tail. The yarn, in the case of heavy yarn, can be cut either by a cutter in the aspirator, by an electric cutter, by a pneumatic cutter or by any similar cutter, sequenced to cut yarn immediately after it has been caught by the hook. Alternatively, the yarn can be cut by a reverse cutter through which the yarn runs, and which will cut the yarn as soon as it reverses direction. The yarn will reverse direction as soon as it is caught in the hook on the rapidly rotating tube or bobbin.

In a second embodiment of the invention, the guide member likewise comprises a metal frame member formed with slots into which the yarn is initially engaged and thereafter moved along the slots, and axially of a tube or bobbin, to form the transfer tail, followed by release of the yarn from a slot to enter the traverse guide, the yarn, when initially caught in the slot, being restrained from entering the traverse guide. The metal frame comprises two substantially co-planar laterally spaced identical sections, integrally interconnected at their centers and at their ends, but with the two sections extending longitudinally in respective opposite directions. Each section comprises a continuous inner longitudinal leg having a center and two end legs extending transversely therefrom in perpendicular relation thereto. Each section further comprises a first cantilever outer leg integral with the transverse leg at one end and a second cantilever outer leg integral with the transverse leg at its center. Each section thus defines an elongated substantially rectangular slot between its inner and outer longitudinal legs and its center and end transverse legs. The free end of each cantilever leg, in cooperation with the adjacent transverse center leg or the adjacent transverse end leg, defines a slot open at both ends. The outer end of each slot is in the form of a very narrow slit of a width just sufficient for entry of the yarn thereinto, and this outer end is followed by a wider portion having a sloping surface so as to increase in width away from the narrow slit portion of the slot. The sloping surface terminates in a short ledge perpendicular to the length of the slot, and this short ledge is followed by a further sloping surface extending to the very substantially wider inner end of the slot. Thus, a yarn engaged in the slit can slip into the wider portion of the slot, move along the sloping surface thereof, move over the ledge, and move over the exit sloping surface to be released into the substantially rectangular aperture defined by the frame section, and in which it is engaged in the traverse guide for cross-winding of a yarn package.

Three retractable pusher elements are associated, respectively, with the center and with each end of the metal frame, each end pusher element being associated with one respective slot and the center pusher element being associated with two slots, one in each frame section. A cam member, similar to that previously mentioned for the first embodiment, is movable longitudinally of the inner longitudinal legs of the two sections, this cam member being actuated by a dual-action pneumatic actuator having its piston connected to the cam member. Initially, the pusher members associated with one of the sections are advanced outwardly by the cam member to near the outer end of the slit portion of the associated slots. The yarn, under a tension tending to move it both longitudinally of the frame member and inwardly toward the traverse guide, is restrained from moving inwardly of the associated slot by the pusher member. The pusher member is then retracted, allowing the yarn to move inwardly out of the narrow slit portion of the slot and over a right angle ledge at the inner end thereof into a position in which the yarn can be caught in the groove or hook of a bobbin or tube, as in the first embodiment. After one or two turns of the yarn have been wound in the groove, the pusher provides for the yarn to move inwardly along the first wider portion of the slot, particularly along the sloping surface thereof, thereby winding a few turns axially along the associated bobbin or tube to form the transfer tail. After this, further retraction of the pusher allows the yarn to move over the ledge connecting the intermediate wider portion to the exit wider portion of the associated slot to terminate the transfer tail, with the pusher then being further retracted so that the yarn will snap into the elongated rectangular slot in each frame section for engagement in the traverse guide for cross-winding of the yarn package. As compared to the first embodiment of the invention, the second embodiment of the invention has the relatively minor disadvantage that the two outer cantilever arms of each frame section are unsupported at their free ends.

In a third embodiment of the invention, the yarn guide member includes an open sided housing arranged to be mounted on a traverse guide housing and including a baseplate and a top wall interconnected by two end walls and a back wall. A main shaft, having a polygonal and preferably square cross-section, is rotatably mounted, by means of bearings, in the two end walls, and is arranged to be oscillated by a rotary pneumatic actuator. The shaft carries a stop pin thereon engageable with limit stops determining the degree of angular movement of the main shaft. A yarn control sleeve is slidably but non-rotatably mounted on the main shaft intermediate the ends thereof, and a doubleacting linear pneumatic actuator includes a cylinder fixedly mounted on the baseplate and a piston and piston rod assembly having a fork engaged in a collar on the yarn control sleeve so as to reciprocate the yarn control sleeve axially.

The control sleeve has radially projecting arms for engaging yarns strung in the winder, and these arms may be arranged in pairs. The sleeve is normally in a position in which these arms are retracted from engagement with a yarn, but can be rotated, by the rotary actuator, to a position in which the arms engage the yarn or yarns.

A second shaft is rotatably mounted in the end walls of the housing adjacent the lower edge of the open front thereof, and this shaft carries an elongated yarn deflecting flap. This second shaft also is preferably a polygonal, such as square, shaft and carries a projecting arm which is operable by a cam fixed on the main shaft.

The winder has one or more chucks, each carrying one or more package supports, such as bobbins or tubes, and a control roller, driven at a constant speed, such as by a synchronous motor, engages each package and controls the speed of an associated chuck in such a manner that the angular velocity or rotational speed of the chuck is varied in accordance with the increasing diameter of the package. The yarn is thus wound at a uniform rate.

The yarn may be strung in such a way that it is initially in the traverse guide closely adjacent the control roller and then engages a bobbin or tube on the chuck, after which the yarn enters into a guide beyond the chuck, such as being below the chuck or to one side of the chuck. In a second manner of stringing, the yarn has a longer arc of contact with the control roller as by being strung behind a bar positioned partly into the nip between the control roller and the bobbin on the chuck, and then engaging a larger arc of the bobbin, after which the yarn enters the guide either below or to one side of the chuck. In the third manner of stringing the yarn, the yarn is strung in what may be termed "an overdrive" manner, in which the yarn is strung around that surface of the control roller adjacent the traverse guide and then between the control roller and the bobbin and around the "backside" of the bobbin to again enter a guide either beneath or to one side of the chuck.

With the yarn strung in the winder in either of the two ways first mentioned above, the rotary actuator is energized to rotate the main shaft to initially cause the cam to engage the arm on the second shaft and thus swing the deflector into a position in which the yarn is moved away from, and retained away from, the traverse guide so that it cannot enter the traverse guide. Upon continued rotation of the main shaft, through an angle of less than 90°, the yarn catching arms on the control sleeve are moved into a position to engage the yarn. The linear actuator is then activated to slide the control sleeve along the main shaft so that the arms on the control sleeve move the yarn into a position aligned with a groove on a bobbin for catching the yarn in the groove, or in a similarly located hook between two bobbins or in front or back of the bobbins or the chuck. After a brief hesitation, the control sleeve is rotated back to its initial position to retract the arms from the yarn so that the yarn forms a few turns on the bobbin extending axially therealong and constituting a transfer tail. The cam is operated, to release the arm on the second or deflector shaft, as the arms near the retracted position, so that the deflector swings back out of engagement with the yarn and the yarn snaps into the traverse guide for cross-winding of the yarn package on the bobbin.

When the yarn is strung in the mentioned "overdrive" manner, the yarn catching arms are in the operative position and the yarn is strung therebetween. Thus, with this stringing arrangement, only the linear actuator is used to slide the control sleeve along the main shaft so that the yarn is moved into alignment with a groove or a hook, the control sleeve is then rotated to disengage the catching arms from the yarn, and the linear actuator retracts the control sleeve to its initial position.

The transfer tail forming mechanism of the invention has numerous advantages over prior art arrangements. For example, the transfer tail mechanism of the invention can form transfer tails for one or more yarn packages being wound on the same chuck, as on a bobbin or tube mounted on the chuck. The mechanism can also be operated to form a transfer tail on either the front side or the back side of the package. When winding on a winder that has two drive rolls running in opposite directions, the transfer tail can be made on the front side of the package, for example, on a righthand chuck and, on the back side of the chucks on the lefthand side as viewed facing the front of the winder. Consequently, when the package is unwound, as in the supply for a texturing machine or the like, both packages will unwind in the same direction. This is important and is required by some yarn processors, because it has been demonstrated that, when two packages unwind in opposite directions, it affects the quality of the yarn. A further advantage of the invention mechanism is that the left side or the right side can be interchanged, as to whether the transfer tail is wound in the front or in the back of the package.

Furthermore, the invention mechanism may be used with "weak yarn" or "partially drawn yarn", which holds in the groove long enough to elongate the yarn until it is wrapped on top of itself, and the yarn is then held in the groove until broken or cut. In this connection, the expression "stabilized yarn" as used hereinafter is more commonly called "drawn yarn", and either "stabilized yarn" or "drawn yarn" is defined, for the purpose of this invention, as yarn which is not materially effected in further textile operations. However, high tenacity yarn will not break when caught in the groove but will tend to pull out of the groove or hook, so that such high tenacity yarn must be cut.

In each embodiment of the invention, the winders used therewith are provided, in accordance with the invention, with yarn guides alongside or beneath the chucks carrying the package supports, such as bobbins or tubes. These yarn guides line up the yarn, as the yarn is strung, with the groove or hook constituting the yarn catching means. The yarn guides are on the "going away" sides of the chucks. The reason for providing these winder guides on the winder is that, when the yarn is cut or broken, the winder guides prevent the cut end of the yarn from flying into the area of the bobbin or tube where the package is to be wound. In other words, the yarn guides on the winder assure that the yarn, when cut and guided into the groove or hook by the mechanism of the invention, will stay in the groove during formation of the transfer tail.

An object of the invention is to provide an improved mechanism for forming transfer tails on wound yarn packages.

Another object of the invention is to provide such a mechanism which, for winding yarn packages of a given size, requires much less space than the space required by prior apparatus.

A further object of the invention is to provide such a transfer tail forming mechanism which is relatively inexpensive, efficient in operation, and easy to use in conjunction with a winder.

For an understanding of the principles of the invention, reference is made to the following description of typical embodiments thereof as illustrated in the accompanying drawings.

BRIEF DESCRIPTION OF THE DRAWINGS

In the Drawings:

FIG. 1 is a perspective view of a yarn package wound on a bobbin or tube having a peripheral groove adjacent one end thereof, with the yarn package being formed with a transfer tail;

FIG. 5 is a partial plan view illustrating the relation of the mechanism of FIG. 4 to a bobbin or tube having a peripheral groove and mounted on a chuck;

FIG. 6 is an end elevation view of the mechanism shown in FIG. 4 as mounted on a traverse guide forming part of a yarn winder;

DESCRIPTION OF THE PREFERRED EMBODIMENTS

Figure 2:
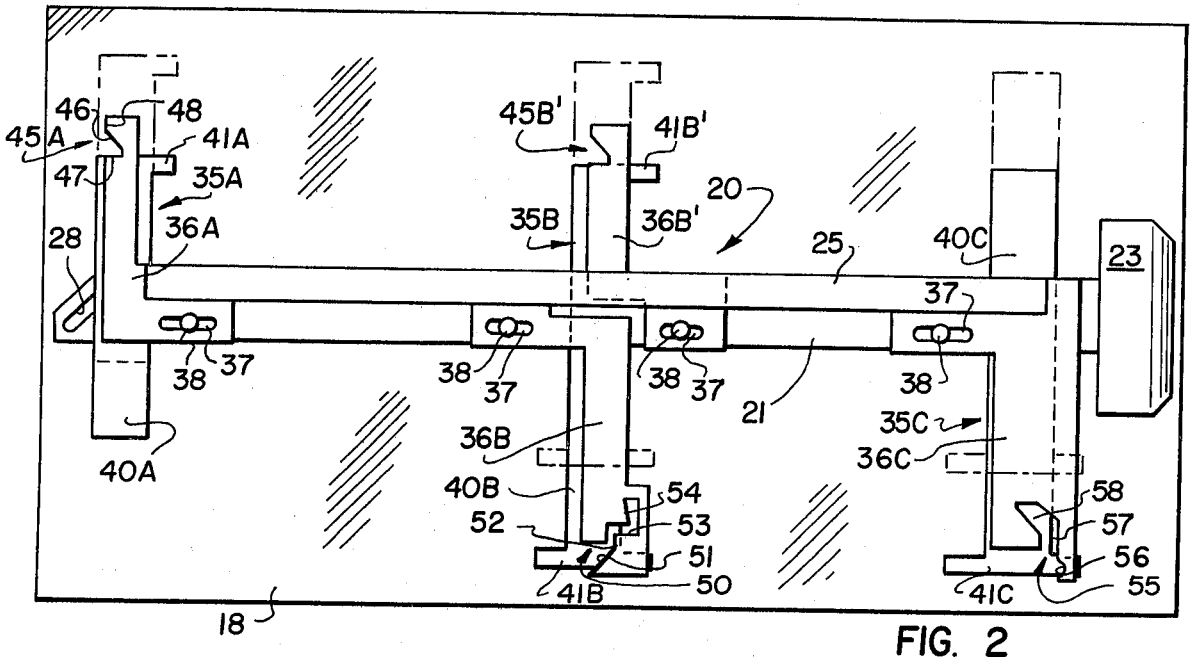
FIG. 2 is a plan view of one embodiment of the transfer tail mechanism of the invention.

Referring first to FIG. 1, a yarn package 16 is illustrated, as wound from yarn 13, on a tubular package support such as a bobbin or tube 15 having a shallow peripheral groove 11 formed in its outer surface adjacent one end 12 thereof, the depth of the groove 11 being shown exaggerated in FIG. 5. While bobbin 15 is illustrated as having only one groove 11, a similar groove may be provided adjacent the opposite end of the bobbin.

In accordance with the invention, the yarn 13 is first caught in the groove 11, after which it is broken or cut, and is then wound peripherally and axially inwardly along the bobbin 12, while the yarn 13 is restrained from entering a traverse guide, to form a transfer tail 14. After forming of the transfer tail, the yarn 13 is released to enter the traverse guide which then cross-winds the yarn package 16 on the bobbin 15. The groove 11 comprises a yarn catching means for the bobbin 15, although other yarn catching means may be provided such as a hook embedded in the groove 11 or otherwise provided on the surface of the chuck 17 adjacent at least one end 12 of the bobbin 15.

Figure 3:
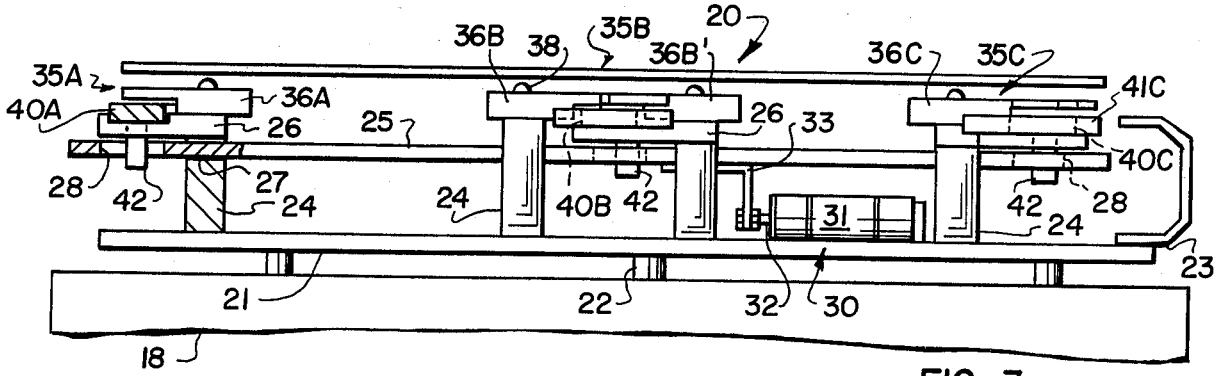
FIG. 3 is an elevation view, partly in section, of the mechanism shown in FIG. 2.

A first embodiment of the mechanism for forming transfer tails on wound yarn packages, in accordance with the invention, is shown in FIGS. 2 and 3, the mechanism being generally indicated at 20 as mounted on the upper surface of the housing or box 18 of a traverse guide 19 forming part of a conventional yarn winder. The mechanism 20 is in the form of a metal frame member including a relatively elongated and relatively narrow metal base 21 supported on posts 22 on traverse guide housing 18, and having a front cover 23 secured to the front end thereof. Four slide brackets 24 are secured to base 21 to extend upwardly therefrom, one adjacent each end of base 21 and two at the center of base 21. Slide holders 26 are secured to each end slide bracket 24 and to the righthand slide bracket at the center of base 21.

The slide supports 24 are slotted, as at 27, to receive a slide actuator 25 in the form of a relatively elongated and relatively narrow bar. For a purpose to be described, bar 25 is formed at each end, and at its center, with diagonal slots 28. A double-acting fluid pressure linear actuator 30 comprises a cylinder 31 secured to base 21, a piston and piston rod assembly 32 reciprocable in cylinder 31, and a bracket 33 connecting assembly 32 to slide 25 for reciprocating the slide 25 longitudinally of base 21.

Each slide holder 26 slidably mounts a respective slide assembly 35A, at the left end of base 21, as viewed in FIG. 2, 35B at the center of base 21, and 35C at the right end of base 21. Slide assembly 35A comprises an L-shape yarn guide 36A, with its longer end extending laterally from base 21, and a control member 40A reciprocable longitudinally of guide 36A. Guide 36A has its shorter arm formed with a slot 37 receiving a bolt 38 securing the guide to the associated slide bracket 24 while providing for adjustment of the guide longitudinally of base 21. Slightly inwardly of its outer end, the longer leg of thread guide 36A is formed with a yarn engaging slot 45A having a sloping surface 46 terminating at an inner end 47. The outer end of sloping surface 46 terminates in a relatively short yarn guiding surface 48. Control member 40A is provided with a control end 41A for engaging a strung yarn in the slot 45A and, intermediate its ends, is provided with a downwardly projecting pin 42 engaged in the adjacent diagonal slot 28 of slide actuator 25. The control end 41A of control member 40A is L-shaped so that it projects laterally from the main body of control member 40A.

Slide assembly 35C comprises two substantially L-shape thread guides 36B and 36B', and a single control member 40B having two yarn-engaging control ends 41B and 41B'. The thread guides 36B and 36B' are mounted on the associated slide brackets 24 by means of the slots 37 and the bolts 38, so that they can be adjusted independently longitudinally of base 21.

Thread guide 36B' has the outer end of its longer arm formed with a yarn engaging slot 45B' which is identical with the slot 45A of thread guide 36A. However, thread guide 36B has its longer arm formed with a slot 50 of a different configuration. Thus, slot 50 has a sloping yarn entry surface 51 extending from its open end, a surface 52 extending parallel to the length of its longer arm following the sloping surface 51, a surface 53 extending perpendicularly to the surface 52, and an inner end surface 54 which slopes in a manner such as to provide a widened inner closed end of the slot 50. As distinguished from the control end 41B', the control end 41B of control member 40B is T-shaped so as to extend completely across the slot 50.

The slide assembly 35C comprises an L-shape thread guide 36C which is again provided with a slot 37 and secured to the associated slide bracket 24 by the bolt 38, the slide assembly 35C comprising a control member 40C which has a T-shape control end 41C. The longer arm of thread guide 36C is formed with a yarn-receiving slot, for engaging a strung yarn or thread, indicated at 55. The slot 55 has an entry end including an arcuate recess 56, followed by a guide surface 57 ascending parallel to the direction of movement of the control member 40C, and then terminating in a rectangular slot 58 having parallel sloping surfaces and forming the closed end of slot 55. As mentioned for the control member 40A, the control members 40B and 40C also have pins 42 extending into the respective diagonal slots 28 of the slide actuator 25.

The operation of the mechanism 20, in guiding a yarn 13 initially into the groove 11 of the bobbin 15 and then along the bobbin 15 to form the transfer tail 14, followed by the release of yarn 13 to enter the traverse guide 19 will now be described with reference to the thread guides 36B and 36C and the associated control members 40B and 40C, it being understood that a similar yarn or thread controlling operation occurs with the thread guides 36A and 36B' and their associated respective control members 40A and 40B. Normally, the control members 40A and 40B are retracted to the dotted line positions shown in FIG. 2, so that the control members are clear of the yarn engaging slots 50 and 55. The yarn is then strung in the winder so that it is initially under tension in a position somewhat to the left of the slide assemblies 35B and 35C, with the yarn associated with assembly 35B being caught in a hook on chuck 17 between the two bobbins 15 thereon. The yarn is then pulled, against the tension, so as to enter the slots 50 and 55, the yarn also being under a tension tending to move the yarn into the traverse guide 19. With the yarn under tension being thus drawn into the inner ends of the slots 50 and 55, the yarn is restrained from entering the traverse guide 19.

At this time, the pneumatic linear actuator 30 is operated, as by supplying pressure to one end thereof and controllably releasing pressure from the opposite end thereof, to move the slide actuator 25. This effects outward movement of the control members 40B and 40C toward their full line positions so that the respective control ends 41B and 41C engage the yarn 13 at the inner ends of the slots 50 and 55. The yarn is thus moved along the sloping surface 54 of slot 50 and the lefthand sloping surface of the inner end of slot 55. Upon continued movement of the control members outwardly along the associated slots, the yarn caught in slot 50 engages the surface 53 and is tensioned to move into engagement with the facing perpendicular surface, and the yarn engaged in slot 58 is moved into engagement with the surface facing the guide surface 57. The yarn then is aligned with the grooves 11 of two bobbins arranged in end-to-end relation on a chuck. With the bobbins being rotated at a relatively high speed, the yarn is caught in the grooves 11 for one or more turns and is either broken or cut while moving along the associated slots. Upon continued movement of the control members 40B and 40C longitudinally outward of the respective slots 50 and 55, the yarn 13 in the slot 50 is then guided outwardly and to the left along the surface 51 of slot 50, and the yarn in slot 55 is also moved outwardly so that several turns are wrapped around each bobbin inwardly of the grooves 11 to form the transfer tail 14. Finally, the control members 40B and 40C displace the yarn 13 completely out of the respective slots 50 and 55 so that the yarn is released to enter the traverse guide for cross-winding of the yarn to form the yarn package 16 of FIG. 1.

Figure 4:
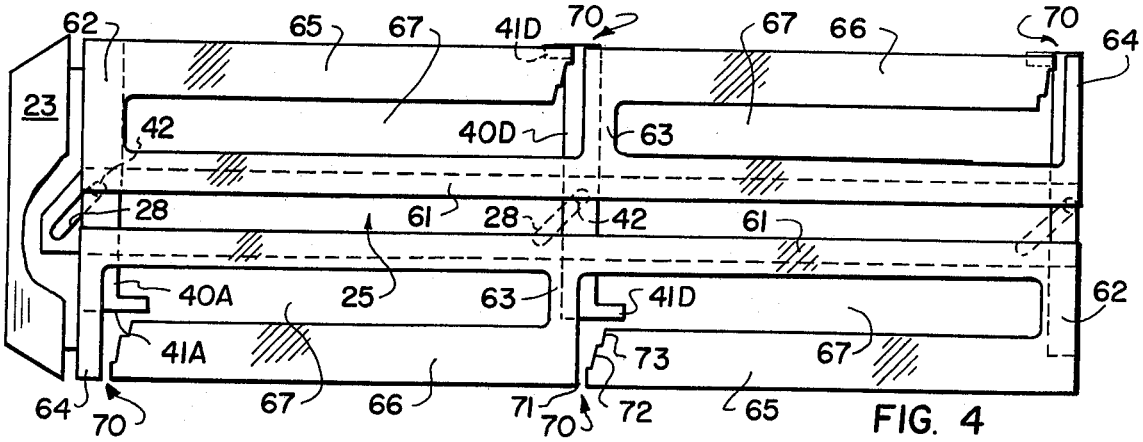
FIG. 4 is a plan view of a second embodiment of the of the mechanism of the invention.

A second embodiment of the invention is illustrated in FIGS. 4, 5 and 6, and is similar, in some respects, to the embodiment of the invention shown in FIGS. 2 and 3. In this embodiment of the invention, a metal frame member is again mounted on traverse guide housing 18, and is provided with the front cover 23 and a slide actuator 25, having diagonal slots 28, identical with the slide 25 of FIGS. 2 and 3 and again operated by a linear pneumatic actuator, such as the actuator 30 of FIGS. 2 and 3.

In this second embodiment of the invention, the horizontally oriented and relatively elongated metal frame member is substantially rectangular and divided into two coextensive and parallel sections each comprising a continuous longitudinal leg 61, a first transverse end leg 62, a transverse central leg 63 and a second transverse end leg 64. However, the two sections are reversed end-to-end as will be apparent from FIG. 4. Each transverse leg 62 has a cantilevered longitudinal outer leg 65 extending therefrom and terminating short of the associated central transverse leg 63, and each center leg 63 has extending longitudinally therefrom a cantilevered outer leg 66 terminating short of the associated end leg 64.

The free end of each cantilever leg 65 and 66 defines, with the adjacent but spaced transverse leg, a respective slot 70. For this purpose, the free end of each cantilever leg is configured to define, with the adjacent transverse leg, a slot 70 having a narrow yarn entrance slit 71 joined by a ledge perpendicular thereto to an intermediate sloping surface 72 in turn joined, by a ledge parallel to the associated cantilever leg, to a sloping surface 73. The configuration of the slots 70, which are identical with each other, is shown to a larger scale in FIG. 5. Each slot 70 opens, at its inner end, into one of the rectangular spaces 67.

Each pair of transverse legs 62–64 have mounted, for slidable reciprocation therealong, a control member 40A having a control end 41A, substantially identical with the control member 41A of FIGS. 2 and 3, and the center transverse legs 63 have mounted, for slidable reciprocation therealong, a control member 40D having two L-shape control ends 41D. Each control member is provided, as in FIGS. 2 and 3, with a respective pin 42 engageable in a slot 28 of slide actuator 25.

The embodiment of the invention shown in FIGS. 4, 5 and 6 operates in a somewhat different manner than does the embodiment of the invention shown in FIGS. 2 and 3, in that the control members 40A and 40D are initially advanced until their control ends are adjacent, but slightly inwardly of, the outer ends of the slit portions 71 of slots 70. This is best seen in FIG. 5. When the winder is strung with yarn, the yarn, under the mentioned tension, is engaged in a slit 71 of a slot 70 and contacts the control end of a control member. The actuator 30 is then activated to retract the control member inwardly along the slot 70. During this retraction, the yarn moves inwardly through the slit portion 71 and over the ledge 68 to engage the intermediate sloping surface 72 which guides the yarn inwardly and to the right, as viewed in FIG. 5. Intermediate the length of sloping surface 72, the yarn is aligned with the groove 11 in a bobbin 15 mounted for high speed rotation on a chuck 17, or otherwise rotated, as by a drive roll. The yarn enters the groove 11 and one or more turns are caught in the groove after which the yarn either breaks or is cut while moving along the associated slots. Upon continued retraction of the control member, the yarn moves further along the sloping surface 72 and over the ledge 68' to engage the exit sloping surface 73. The yarn, in engagement with the exit sloping surface 73, moves along this surface, with continued retraction of the control member, to form a transfer tail 14 extending peripherally and axially of the bobbin 15 inwardly away from the groove 11. Finally, the control member is completely retracted from the slot 70 and the yarn is released from the inner open end of the slot into a space 67 for entry into the traverse guide for cross-winding of the yarn to form the package 16 on the bobbin 15, as shown in FIG. 1. As compared to the embodiment of the invention shown in FIGS. 2 and 3, that shown in FIGS. 4 and 5 has the relatively minor disadvantage that the arms 65 and 66, which are relatively long, are cantilever arms and thus fixedly supported at only one end thereof.

Referring to FIG. 6, this is an end elevation view illustrating the traverse guide housing 18 with the mechanism 60, of the invention, mounted thereon and arranged to form packages, having transfer tails, on four bobbins 15. The bobbins are driven at relatively high angular velocities by large diameter drive rollers 74, each driving two bobbins 15. In this case, all four slots 70 of the metal frame member of FIGS. 4 and 5, with their associated control members, are used. It will be noted that the mechanism thus provides for winding a large amount of yarn in a relatively small space, which is a distinct advantage over prior art arrangements for forming transfer tails.

FIGS. 7, 8, 9 and 10 show a third embodiment of the invention. In this embodiment of the invention, the mechanism for forming transfer tails and embodying the invention is generally indicated at 75 as again mounted on traverse guide housing 18. The bobbin 15 is mounted on a chuck 17 driven at a relatively high rate of speed to form the package 16, which is engaged by a control roller 76 driven at a constant speed and controlling the speed of chuck 17 in accordance with the diameter of package 16. In the winder, the yarn 13 may be initially trained along part of the surface of control roller 76 and then past bobbin 15 to enter a yarn reciever or guide 77. Alternatively, a yarn 13' may be strung so as to engage the control roller 76 and then be strung inwardly of a bar 78, around a larger arc of the periphery of bobbin 15 and into a yarn receiver of guide 77'. If the "overdrive" yarn stringing arrangement is to be used, a yarn 13'' is initially trained along part of the surface of control roller 76 and then engaged between control roller 76 and the bobbin 15 on chuck 17, following which the yarn is engaged with the "backside" of the bobbin 15 and led into a guide such as the guide 77, 77'. The yarn 13'' is indicated by a dash and double dot line. The guides, such as 77 and 77', are provided in accordance with the invention to align the yarns originally with a groove in a bobbin, or with a hook on either the bobbin or on the chuck, so that, when the yarn is cut, the cut end will not "fly" into the area of the bobbin 15 on which the package 16 is to be wound.

Bobbin 15 is again formed with a peripheral groove 11 in its outer surface adjacent an end 12 thereof, or a hook may be provided on chuck 17, and the mechanism 75 is arranged to guide the yarn 13 or 13' into groove 11, for example, to wrap one or more turns therein, followed by breaking or cutting of the yarn, and then to guide the yarn axially and peripherally along the bobbin 15 inwardly from the groove 11 to form the transfer tail 14, after which the yarn is released to enter the traverse guide 19 for cross-winding of the yarn to form the package 16.

The mechanism 75 is mounted in or on a housing 80 including a relatively elongated base 81, end walls 82, a top wall 83, and a back wall 84, housing 80 being open at its front facing toward drive roll 74.

Mechanism 75 includes a main shaft 85 rotatably mounted, at its opposite ends, substantially centrally in end walls 82. Shaft 85 has a square cross-section for at least a major portion of its length, and has mounted thereon, for reciprocation therealong but not rotatable with respect thereto, a control sleeve 86 having rings 87 adjustably mounted thereon in pairs and each carrying a yarn engaging arm 88. Two of the yarn engaging arms 88 extend rectilinear and radially from the associated ring 87 and two of the arms 88 are bent adjacent their outer ends. A rotary actuator 90, which is air pressure operated, is secured to shaft 85 at one end thereof and, near its opposite end, shaft 85 carries a cam 91. The shaft 92 of rotary actuator 90 projects through the adjacent end wall 82 and has secured thereon a radial arm 93. Arm 93 is engageable with either of a pair of angularly spaced stops 94 for limiting the rotation of shaft 85 by rotary actuator 90.

Control sleeve 86 is reciprocated axially of main shaft 85 by a double-acting, pneumatic linear actuator 95 comprising a cylinder 96 secured to base 81 and a piston and piston rod assembly 97 having a fork 98 at its outer end engaged in a groove or collar 99 on sleeve 86.

Below and outwardly of main shaft 85, a second square cross-section shaft 101 extends between end walls 82 and is rotatably mounted therein. Shaft 101 has secured thereto a yarn deflector 100 in the form of an elongated downwardly extending flap, and also has secured thereto an arm 102 cooperable with the cam 91.

The arrangement shown in FIGS. 7 through 10 operates in the following manner. Normally the parts occupy the solid line positions shown in FIG. 7. After the yarn 13 or 13' has been strung in the winder, as mentioned above, rotary actuator 90 is activated to rotate shaft 85 clockwise, as viewed in FIG. 7. Initially, cam 91 moves arm 102 downwardly to oscillate second shaft 101 in a direction to swing yarn deflector flap 100 outwardly to engage the yarn 13 or 13' and restrain it from entering the traverse guide 19. By continuing operation of rotary actuator 90, the control sleeve 86 is moved into a position in which the arms 88 extend substantially horizontally, as shown in dotted lines in FIG. 7, to engage the yarn 13 or 13' therebetween. A second control is then actuated and linear actuator 95 moves control sleeve 86 to the left, as viewed in FIG. 7, or to the right, as viewed in FIG. 9. This moves the engaged yarn along flap 100 into a position where it is aligned with the groove 11 in a bobbin 15, so that the yarn is caught in the groove for one or two turns, after which the yarn is broken or is cut. Rotary actuator 90 is then activated again to rotate shaft 85 counterclockwise, as viewed in FIG. 7, retracting arms 88 out of engagement with the yarn. The yarn then moves along the deflector 100 and forms the transfer tail on bobbin 15 inwardly of groove 11. As shaft 85 nears its retracted position, the arm 102 is released by cam 91 so that flap 100 swings back to its solid line position, releasing yarn 13 or 13' to enter traverse guide 19 for cross-winding of a package 16 on bobbin 15. At the same time, linear actuator 95 is operated to move control sleeve 86 back to the position shown in solid lines in FIG. 7.

Figure 7:
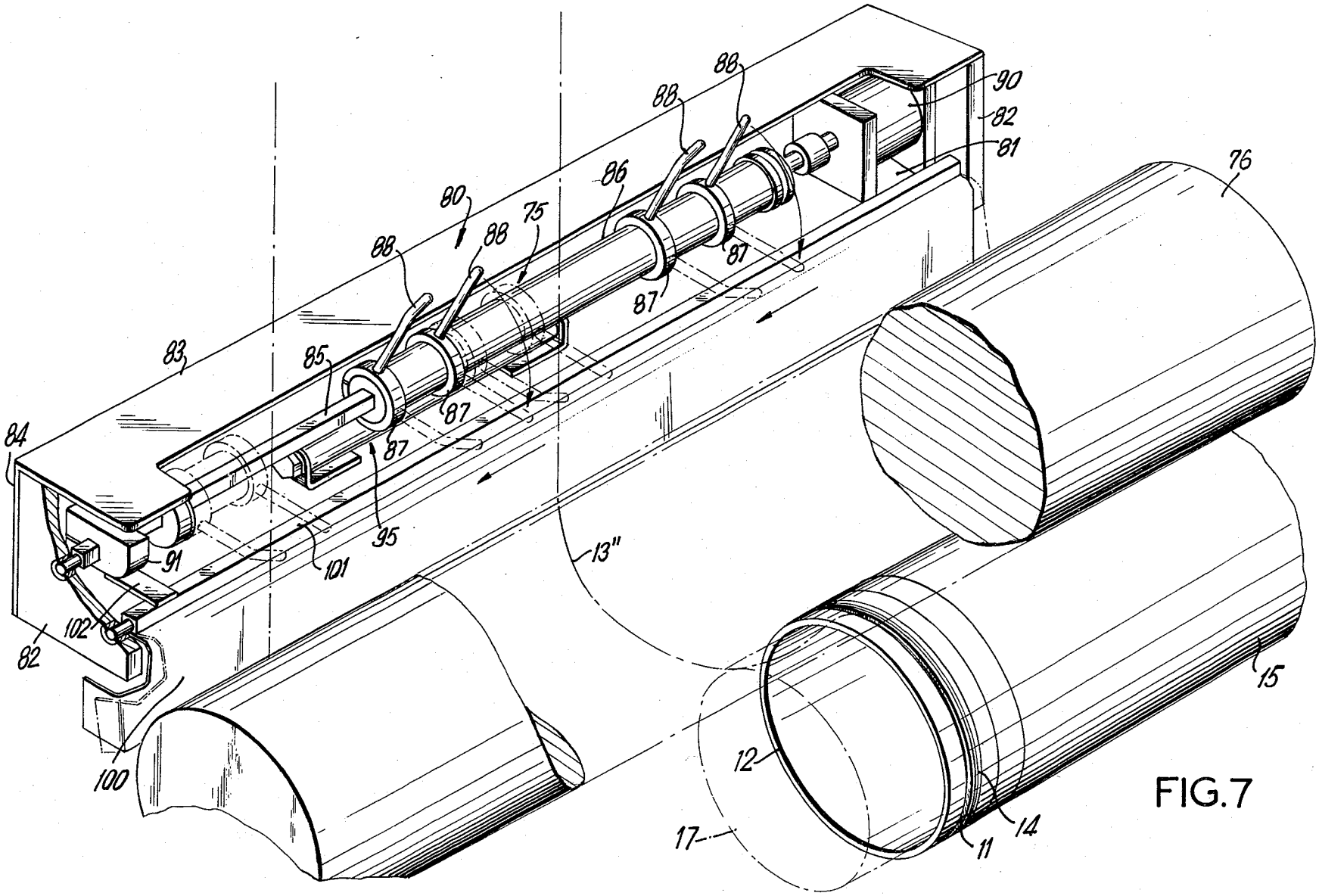
FIG. 7 is a perspective view, partly broken away, illustrating a third embodiment of the mechanism of the invention in association with a bobbin drive roll and a bobbin.
Figure 8:
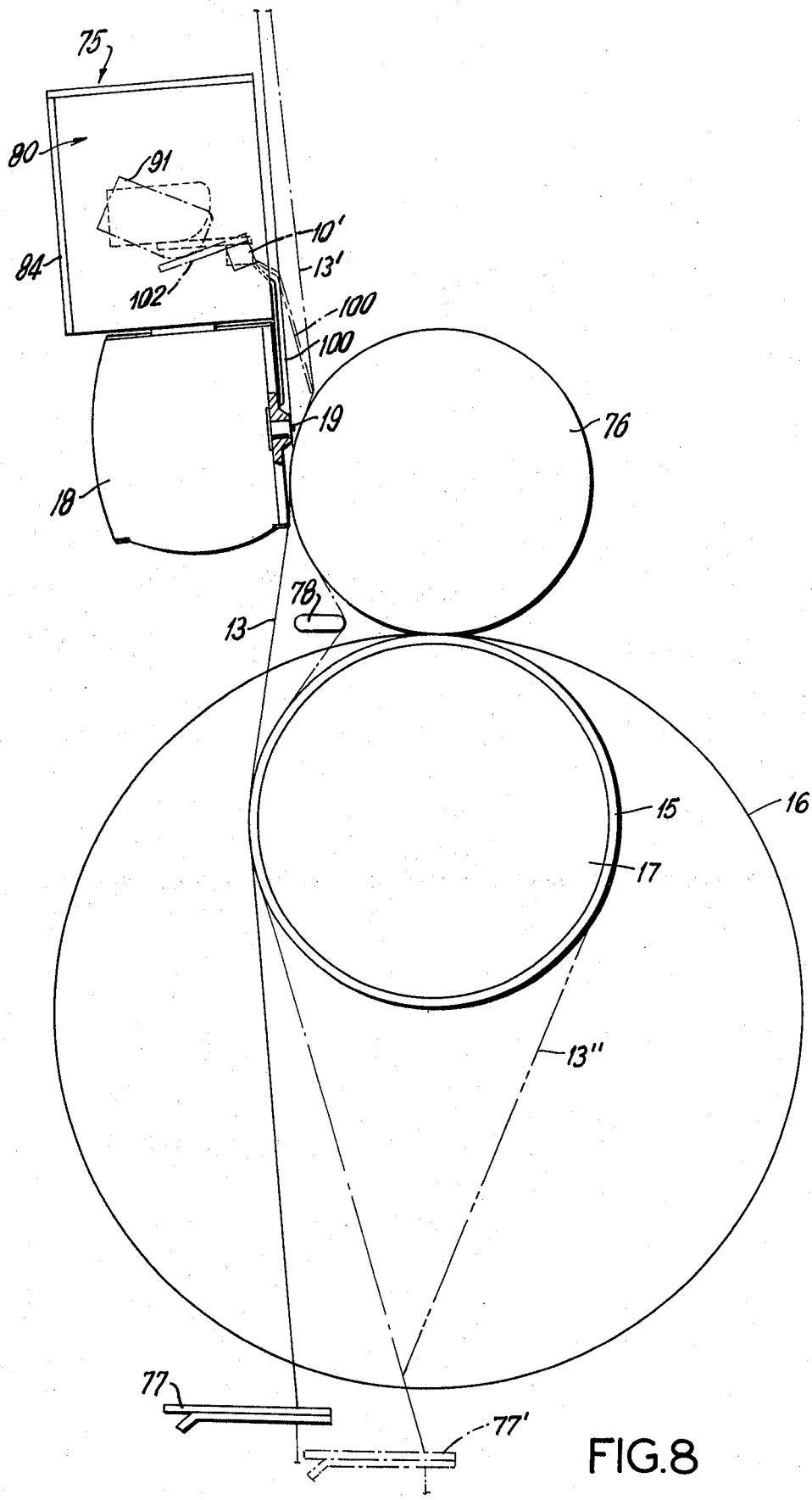
FIG. 8 is an elevation view illustrating the mechanism of FIGS. 7, 8 and 9 as mounted on a traverse guide and in association with the drive roll and the bobbin.
Figure 9:
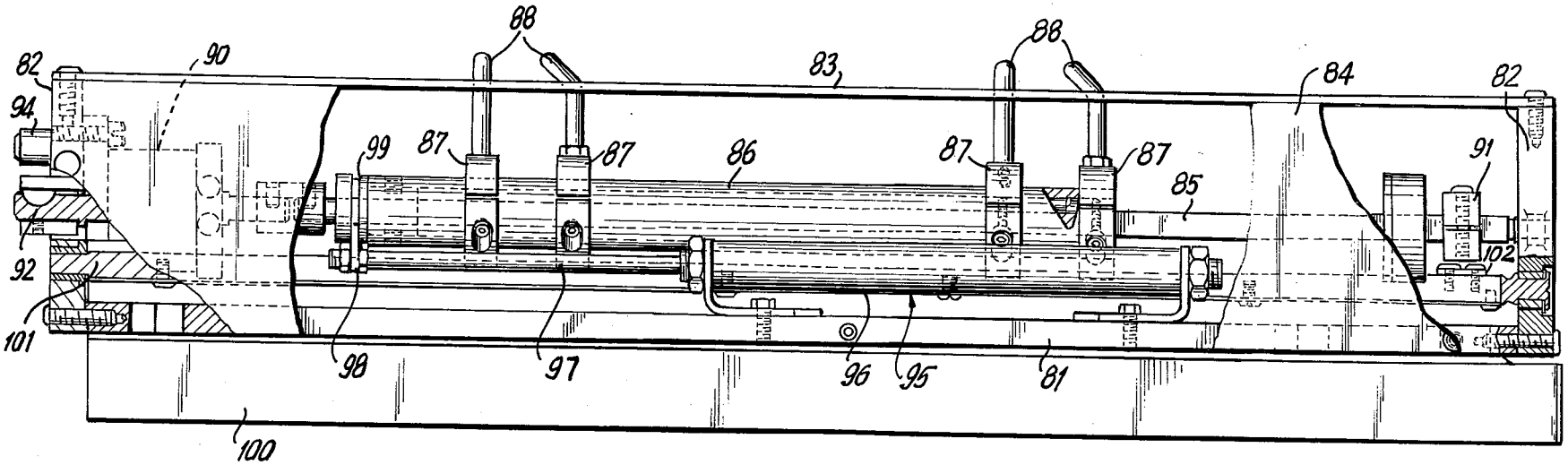
FIG. 9 is a back elevation view of the mechanism shown in FIG. 7, partially in section.
Figure 10:
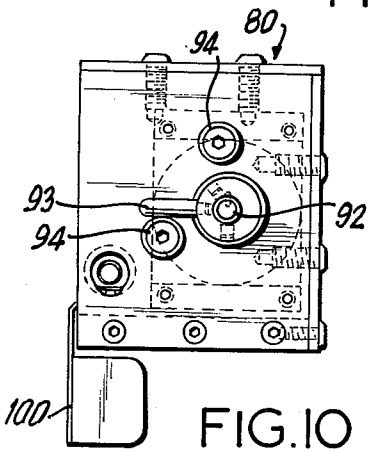
FIG. 10 is a right end elevation view of the mechanism shown in FIGS. 7 and 8.
Figure 11:
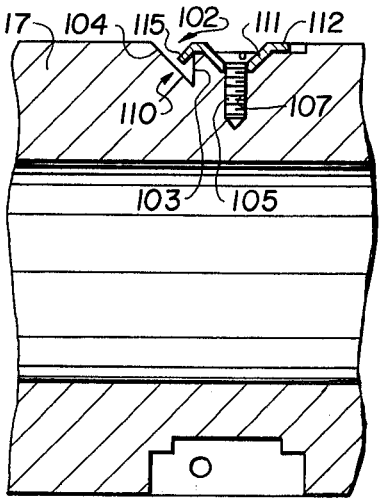
Figure 12:
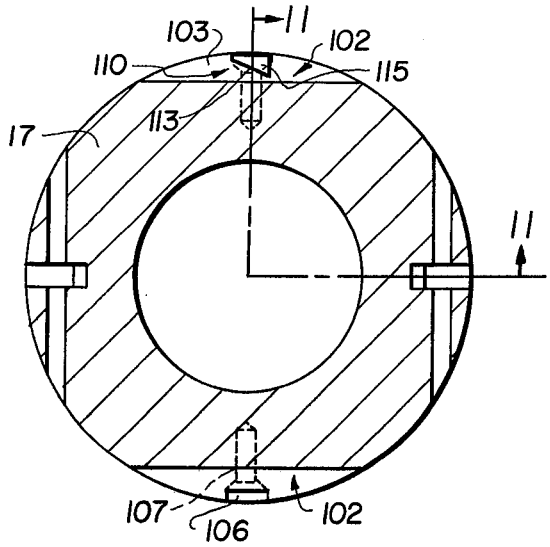
Figure 13:
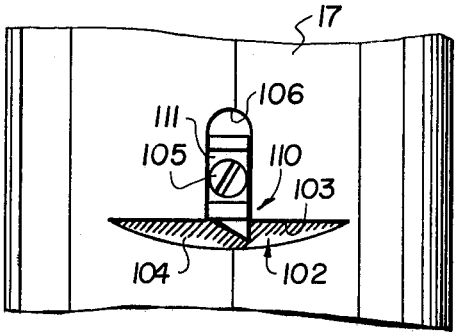

When the yarn is strung in the "overdrive" manner, as illustrated by the yarn 13" in FIG. 8, arms 88 are initially in their yarn engaging position. Upon actuation of a control, control sleeve 86 is moved axially to guide the yarn into yarn catching means, such as the groove 11 in a bobbin 15. After this, rotary actuator 90 rotates shaft 85 counterclockwise to retract arms 88 out of engagement with the yarn, so that the yarn is then wound along bobbin 15 for a few turns, inwardly of groove 11, to form the transfer tail. At or about the same time, control sleeve 86 is moved back to its solid line position as shown in FIG. 7. While guides on the "backside" of a chuck have been shown only in the arrangement of FIGS. 7 through 10, it should be understood that similar guides are provided with the first two embodiments of the invention and for the same purpose.

In the arrangement of FIGS. 7 through 10, it is possible to have a second chuck parallel to and outwardly of chuck 17, with respect to the yarn guiding mechanism. Bobbins or tubes on the second chuck can be engaged with a yarn to form a transfer tail in the same manner as previously described, while the bobbins on the chuck 17 nearer the mechanism are winding yarn packages 16. However, in starting the winding of the bobbins on the second or outer chuck, the retaining flap 100 cannot be used.

While specific embodiments of the invention have been shown and described in detail to illustrate the application of the principles of the invention, it will be understood that the invention may be embodied otherwise without departing from such principles.

What is claimed is:

1. Mechanism for forming transfer tails on yarn packages wound on package supports, such as a bobbin or tube, mounted on a yarn winder having a traverse guide for cross-winding yarn, strung in the winder, on the package supports, while the latter are rotated at a high speed by the winder, with yarn catching means adjacent an end of the package supports: said mechanism comprising, in combination, yarn engaging means adjacent a traverse guide selectively operable to have engaged therein a yarn, strung in the winder and fed into yarn receiving means of the winder under a tension tending to move the strung yarn into the traverse guide; yarn restraining means movable relative to said engaging means into a first position to restrain the yarn from entering into the traverse guide, and into a second position releasing the yarn to enter the traverse guide; and yarn movement control means, including said movable restraining means, cooperable with said engaging means to effect movement of the yarn, engaged in said engaging means, into alignment with the yarn catching means on a package support for winding of at least one turn of yarn on such package support at the catching means thereon, and then to effect movement of the yarn, while engaged in said engaging means, along such package support to wrap several turns of the yarn directly onto the package support to form a transfer tail extending along a selected length of the package support axially inwardly of the catching means thereof; said movement control means, following formation of the transfer tail, effecting disengagement of the yarn from said engaging means, and release of the yarn from said restraining means, by movement of said restraining means to its second position, to enter the traverse guide for formation of a yarn package on the yarn package support.

2. Mechanism for forming transfer tails on yarn packages wound on package supports, such as bobbin or tube, mounted on a yarn winder having a traverse guide for cross-winding yarn, strung in the winder, on the package supports while the latter are rotated at a high speed by the winder, with yarn catching means adjacent an end of the package supports: said mechanism comprising, in combination, yarn engaging means adjacent a traverse guide selectively operable to have engaged therein a yarn, strung in the winder and fed into yarn receiving means of the winder under a tension tending to move the strung yarn into the traverse guide; means operable to restrain the yarn from entering into the traverse guide; and yarn movement control means cooperable with said engaging means to effect movement of the yarn, engaged in said engaging means, into alignment with the yarn catching means on a package support for winding of at least one turn of yarn on such package support at the catching means thereon, and then to effect movement of the yarn along such package support to wrap several turns of the yarn directly onto the package support to form a transfer tail extending along a selected length of the package support axially inwardly of the catching means thereof; said movement control means and said restraining means, following formation of the transfer tail, cooperably effecting release of the yarn from said engaging means and said restraining means to enter the traverse guide for formation of a yarn package on the yarn package support; said yarn engaging means comprising a substantially horizontal metal frame member formed with at least one slot having at least one open end and arranged to have a strung yarn engaged therein; each slot having consecutive yarn guiding surfaces including a first yarn guiding surface aligned with the catching means on an associated package support for guiding of the strung yarn into such catching means, an intermediate guiding surface for guiding the yarn axially of the associated package support to form the transfer tail, and an exit guiding surface for guiding the yarn out of the slot for release to enter the traverse guide; said yarn movement control means comprising control members mounted for movement on said frame member, each associated with a respective slot and each having a yarn control end engageable with the strung yarn in the associated slot; and means operable to reciprocate each control member along the associated slot to control movement of the engaged strung yarn, under tension, along the consecutive guiding surfaces of the associated slot.

3. Mechanism for forming transfer tails, as claimed in claim 2, in which said frame member is elongated in a direction parallel to the axis of rotation of an associated yarn package support; said control members comprising relatively elongated control elements mounted on said frame member for reciprocation transversely of said frame member; said means for reciprocating said control members comprising a cam member mounted on said frame member for reciprocation longitudinally thereof and operatively engaged with each of said control members; and a double-acting linear actuator connected between said frame member and said cam member and operable to reciprocate said cam member longitudinally of said frame member to reciprocate said control elements transversely of said frame member.

4. Mechanism for forming transfer tails, as claimed in claim 3, in which said double-acting linear actuator is a pnematic piston-cylinder actuator comprising a cylinder secured to said frame member and a piston connected to a piston rod in turn connected to said cam member; and control means selectively operable to control the supply and exhaust of air relative to said cylinder to control transverse reciprocation of said control elements.

5. Mechanism for forming transfer tails, as claimed in claim 3, in which said frame member comprises a relatively elongated central base; plural yarn guides mounted on said base in longitudinally spaced relation therealong and projecting transversely from said base, each yarn guide having a respective yarn receiving slot, with each slot having a closed inner end and opening outwardly of the associated yarn guide; said cam member comprising a relatively elongated slide actuator mounted on said base for reciprocation longitudinally of said base; said control members comprising relatively elongated slides each slidably mounted on a respective yarn guide for reciprocation longitudinally of the associated yarn guide; each slide having a respective pin projecting therefrom; said cam member having respective slots formed therein and extending diagonally thereof, each slot slidably receiving a respective pin; said actuator comprising a pneumatic actuator including a piston secured to said base and a piston rod assembly reciprocable in said cylinder; and a bracket connecting said piston rod assembly to said cam member; the strung yarn being initially engaged in the inner ends of said slots with said control member slides being retracted; said actuator operating said control member slides to move outwardly of the associated yarn guides to move the yarn in the respective slots along said successive guiding surfaces of said slots to move the yarn into the catching means of an associated package support, then to move the yarn longitudinally of the associated package support to form the transfer tail, and finally to move the yarn out of the associated slot for release to enter the traverse guide.

6. Mechanism for forming transfer tails, as claimed in claim 5, in which said restraining means comprises formations on the outer ends of said yarn guides; the yarn being disengaged from said formations by outward movement of said control member slides.

7. Mechanism for forming transfer tails, as claimed in claim 3, in which said frame member comprises a support base; at least one open frame mounted on said support base and including an elongated inner leg extending the full length of said open frame, first and second transverse legs extending perpendicularly outwardly from said inner leg at respective ends thereof, an intermediate leg extending perpendicularly outwardly from said inner leg at substantially the midpoint thereof, a first outer longitudinal leg extending from said intermediate leg parallel to said inner leg to adjacent said first end leg, and a second outer longitudinal leg extending from said second end leg to adjacent said intermediate leg; said legs of said open frame defining two elongated substantially rectangular openings aligned in said frame; the free ends of said outer longitudinal legs, in association with said one end leg and said intermediate leg, respectively, defining said yarn engaging slots; each yarn engaging slot including a narrow outer end portion constituting said first guide surface of the slot and arranged to have a strung yarn engaged therein; each slot including an intermediate portion tapering in width and having said intermediate guiding surface, and further including a widened portion opening into the associated frame opening and constituting said exit guiding portion; said control members comprising control slides slidably mounted on said frame for reciprocation longitudinally of the associated slots, and each control slide having a pin extending therefrom; said cam member comprising an elongated slide actuator extending parallel to the inner longitudinal leg of said frame and formed with diagonal slots each engaged with a respective one of said pins; said linear actuator comprising a pneumatic actuator including a cylinder secured to said support base and a piston rod assembly reciprocal in said cylinder; a bracket securing said piston rod assembly to said cam member to reciprocate said cam member longitudinally of said base to reciprocate said control slides transversely of said frame; and means controlling supply and exhaust of air relative to said cylinder to control movement of said control slides; said control slides being initially positioned slightly inwardly of the outer narrow ends of said slots, and the strung yarn being initially engaged in the narrow outer ends of said slots and tensioned against the control ends of the associated slides; said slide actuator retracting said control slides along the associated slots for movement of the strung yarn initially into alignment with the catching means of the associated package support and then axially along the associated package support to form the transfer tail and then inwardly to a position in which the control end of each slide is spaced inwardly from the associated outer longitudinal leg to release the yarn into the associated frame opening for entering into the traverse guide.

8. Mechanism for forming transfer tails, as claimed in claim 7, in which the narrow outer end portions of said slots and the control ends of the associated control slides constitute said means restraining entry of the strung yarn into the traverse guide.

9. Mechanism for forming transfer tails on yarn packages wound on package supports, such as a bobbin or tube, mounted on a yarn winder having a traverse guide for cross-winding yarn, strung in the winder, on the package supports while the latter are rotated at a high speed by the winder, with yarn catching means adjacent an end of the package supports: said mechanism comprising, in combination, yarn engaging means adjacent a traverse guide selectively operable to have enaged therein a yarn, strung in the winder and fed into yarn receiving means of the winder under a tension tending to move the strung yarn into the traverse guide; means operable to restrain the yarn from entering into the traverse guide; and yarn movement control means cooperable with said engaging means to effect movement of the yarn, engaged in said engaging means, into alignment with the yarn catching means on a package support for winding of at least one turn of yarn on such package support at the catching means thereon, and then to effect movement of the yarn along such package support to wrap several turns of the yarn directly onto the package support to form a transfer tail extending along a selected length of the package support axially inwardly of the catching means thereof; said movement control means and said restraining means, following formation of the transfer tail, cooperably effecting release of the yarn from said engaging means and said restraining means to enter the traverse guide for formation of a yarn package on the yarn package support; said yarn engaging means comprising a relatively elongated metal frame extending substantially parallel to the axis of rotation of an associated package support and mounted on a traverse guide housing, said frame having a pair of longitudinally spaced end walls; a main shaft extending between and rotatably mounted in said end walls; a control sleeve slidably and non-rotatably mounted on said main shaft; longitudinally spaced yarn engaging arms extending symmetrically radially outwardly of said control sleeve; a rotary actuator operable to rotate said main shaft; means limiting rotation of said main shaft to a retracted position in which said yarn engaging arms extend upwardly from said control sleeve and a position in which said yarn engaging arms extend substantially horizontally from said control sleeve to enage a strung yarn; a doubleacting linear actuator connected between said frame and said control sleeve and operable to reciprocate said control sleeve along said main shaft; said winder including a control roller closely adjacent said traverse guide and arranged above and in engagement with a package support; and control means for said rotary and linear actuators operable initially to rotate said main shaft to move said yarn engaging arms from the upwardly extending retracted position to the horizontally extending strung yarn engaging position to engage a strung yarn, then to move said control sleeve axially along said main shaft to engage the strung yarn in the catching means of the associated package support, then to rotate said main shaft to move said yarn engaging arms to the retracted position for movement of the strung yarn along the package support to form the transfer tail with the strung yarn being restrained from entering the traverse guide, and then to move said control sleeve axially along said main shaft to its initial position; said restraining means restraining the strung yarn from entering the traverse guide until said transfer tail has been formed and thereafter releasing the strung yarn to enter the traverse guide.

10. Mechanism for forming transfer tails, as claimed in claim 9, in which said restraining means comprises a second shaft extending between said end walls and rotatably supported therein at a point downwardly and inwardly relative to the support points of said main shaft; a flap secured to said second shaft and normally having a position retracted out of engagement with strung yarn; and cam means operable by said control means and operatively associated with said second shaft to angularly displace said second shaft, in advance of engagement of the strung yarn by said yarn engaging arms, to move said flap in a direction to restrain the strung yarn from entering the traverse guide; said control means operating said cam means to release said second shaft for movement of said flap into its retracted position only following formation of the transfer tail on the associated package support.

11. Mechanism for forming transfer tails, as claimed in claim 10, in which said rotary actuator is a fluid pressure rotary actuator.

12. Mechanism for forming transfer tails, as claimed in claim 10, in which said linear actuator is a pneumatic double-acting linear actuator including a cylinder secured to said frame, a piston-piston rod assembly reciprocable in said cylinder, and a fork secured to said piston-piston rod assembly and engaged in a collar on said control shaft.

13. Mechanism for forming transfer tails, as claimed in claim 1 including yarn catching means comprising at least one peripheral groove in the external surface of each package support adjacent an end thereof.

14. Mechanism for forming transfer tails, as claimed in claim 1, including yarn catching means comprising a hook on a chuck mounting at least one package support thereon.

15. Mechanism for forming transfer tails, as claimed in claim 1, in which each yarn, engaged in a yarn engaging means, is severed from the yarn fed into the yarn receiving means of the winder after winding of said at least one turn of yarn on the package support and before formation of the transfer tail.

16. Mechanism for forming transfer tails, as claimed in claim 1, including yarn catching means comprising an external peripheral groove in each package support adjacent an end thereof; said winder comprising chucks each having at least one package support telescoped thereon; said yarn receiving means of the winder including respective strung yarn guides downstream of said chucks in the direction of yarn movement during stringing of the yarn, each strung yarn guide being aligned with a respective peripheral groove in a package support; the yarn engaged in a yarn engaging means being severed from the yarn entering said yarn receiving means following winding of said at least one turn of yarn on the associated package support in the respective groove thereof and before formation of the associated transfer tail, said spun yarn guides preventing the severed yarn from "flying" along the package support into the area in which the associated yarn package is wound on the yarn package support by the traverse guide.

* * * * *